US011389937B2

(12) United States Patent
Klatt

(10) Patent No.: US 11,389,937 B2
(45) Date of Patent: Jul. 19, 2022

(54) LIGHT INSTALLATION TOOL

(71) Applicant: William Darren Klatt, Campbell River (CA)

(72) Inventor: William Darren Klatt, Campbell River (CA)

( * ) Notice: Subject to any disclaimer, the term of this patent is extended or adjusted under 35 U.S.C. 154(b) by 0 days.

(21) Appl. No.: 17/028,975

(22) Filed: Sep. 22, 2020

(65) Prior Publication Data

US 2022/0088756 A1 Mar. 24, 2022

(51) Int. Cl.
*B25B 27/00* (2006.01)
*B25B 27/14* (2006.01)

(52) U.S. Cl.
CPC ..... *B25B 27/0035* (2013.01); *B25B 27/14* (2013.01)

(58) Field of Classification Search
CPC .. H01J 9/003; H01J 9/006; H01K 3/32; B25B 27/0035; B25B 27/14; B25B 13/48; H01H 85/0208; B60Q 1/0064; B60Q 1/32; F21V 19/04; F21V 19/047
USPC ..... 29/758; 81/53.1, 53.11, 53.12
See application file for complete search history.

(56) References Cited

U.S. PATENT DOCUMENTS 5,317,939 A * 6/1994 Marinescu ..... H01K 3/32 294/100
6,678,931 B1 * 1/2004 Tatasciore ..... B25B 27/0035 29/239

OTHER PUBLICATIONS

Author: Ettore, Title: Bulb Changer Kit, Publication Date: Aug. 15, 2020, URL: https://ettore.com/products/bulb-changer-kit-without-pole (Year: 2020).*

* cited by examiner

*Primary Examiner* — Lee D Wilson
*Assistant Examiner* — Alberto Saenz
(74) *Attorney, Agent, or Firm* — Orin Del Vecchio

(57) ABSTRACT

A light installation tool configured to provide installation of clearance lights and brake lights on a trailer. The light installation tool of the present invention includes a body having a handle and a lever. The lever is pivotally movable with respect to the handle and is operably coupled with a drive mechanism. The drive mechanism is operably coupled with a plunger rod wherein the drive mechanism is operable to provide discrete movements of the plunger rod. A base plate is formed on the body and the base plate includes a light insertion member mounted thereto. The light insertion member has a bottom and a wall contiguously formed to define an interior volume wherein an opening is present distal to the bottom. The wall of the light insertion member is comprised of a plurality of segments wherein the segments are arranged in a longitudinal manner between the opening and the bottom.

11 Claims, 3 Drawing Sheets

LIGHT INSTALLATION TOOL

FIELD OF THE INVENTION

The present invention relates generally to trailer equipment maintenance tools, more specifically but not by way of limitation, a clearance light installation tool configured to provide installation of lights on a trailer or other commercial vehicle such as but not limited to in particular a trailer for commercial tractor trailers or other commercial equipment.

BACKGROUND

Millions of tractor trailers, also known as eighteen wheelers traverse the roads on a daily basis. Additionally commercial vehicles such as but not limited to various types of heavy equipment like dump trucks are utilized by thousands every day. These tractor trailers and other commercial vehicles serve a vital function in our economy by delivering a plurality of goods everyday. There are numerous different type of trailers and commercial vehicles that can include but are not limited to conventional box trailers, tank car trailers, dump trucks, cranes and other vehicles. Regardless of the type of trailer or commercial vehicle, all trailers are required to have a minimal amount of lighting. This lighting is most often integrated into the frame and/or structure of the trailer or vehicle and the lights function to provide either illumination during braking as well as mark the perimeter and/or corners of the trailer.

The aforementioned lights require routine maintenance wherein the most common task is the replacement thereof. The clearance lights eventually burn out and it is necessary to replace. Most of these lights are single assemblies and are manufactured as such to maintain the water resistance of the unit. Due to the structure of these clearance lights they present a challenge during the removal and replacement thereof. While the removal can most often be accomplished with a prying action utilizing a conventional tool such as but not limited to a screwdriver, the reinstallation is significantly more challenging. Current methodologies for reinstallation are cumbersome and often can result in damage to the trailer or to the light assembly.

It is intended within the scope of the present invention to provide an installation tool for a clearance light to facilitate the installation thereof wherein the present invention is operable to offer a simplified installation process of a replacement clearance light assembly.

SUMMARY OF THE INVENTION

It is the object of the present invention to provide a clearance light assembly tool configured to install a clearance light on a trailer or other commercial vehicles wherein the present invention includes a handle assembly having a first lever wherein the first lever is movably mounted to a handle.

Another object of the present invention is to provide an installation tool configured to install clearance light assemblies into trailers or other commercial vehicles wherein the first lever is operably coupled to a plunger assembly.

A further object of the present invention is to provide a clearance light assembly tool configured to install a clearance light on a trailer or other commercial vehicles wherein the plunger assembly includes a rod having a first end and a second end and wherein the plunger assembly is movable in a first and second direction.

Still another object of the present invention is to provide an installation tool configured to install clearance light assemblies into trailers or other commercial vehicles wherein the second end of the rod includes an engagement knob secured thereto.

An additional object of the present invention is to provide a clearance light assembly tool configured to install a clearance light on a trailer or other commercial vehicles wherein the present invention further includes a base plate wherein the rod of the base plate is movably journaled therethrough.

Yet a further object of the present invention is to provide an installation tool configured to install clearance light assemblies into trailers or other commercial vehicles wherein the base plate has a light insertion member operably coupled thereto.

Another object of the present invention is to a provide a clearance light assembly tool configured to install a clearance light on a trailer or other commercial vehicles wherein the light insertion member is annular in shape having an outer wall and an interior volume.

An alternate object of the present invention is to provide an installation tool configured to install clearance light assemblies into trailers or other commercial vehicles wherein the light insertion member has an opening distal to the base plate.

Still a further object of the present invention is to provide a clearance light assembly tool configured to install a clearance light on a trailer or other commercial vehicles wherein the outer wall of the light insertion member is comprised of a plurality of longitudinal segments.

An additional object of the present invention is to provide an installation tool configured to install clearance light assemblies into trailers or other commercial vehicles wherein the light insertion member further includes an o-ring mounted to the exterior surface of the outer wall thereof.

A further object of the present invention is to provide a clearance light assembly tool configured to install a clearance light on a trailer or other commercial vehicles wherein the light insertion member is configured to be journaled into the interior volume of a clearance light on a trailer.

An alternative objective of the present invention is to provide an installation tool configured to install clearance light assemblies into trailers or other commercial vehicles wherein the light insertion member is operably coupled to the plunger rod.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
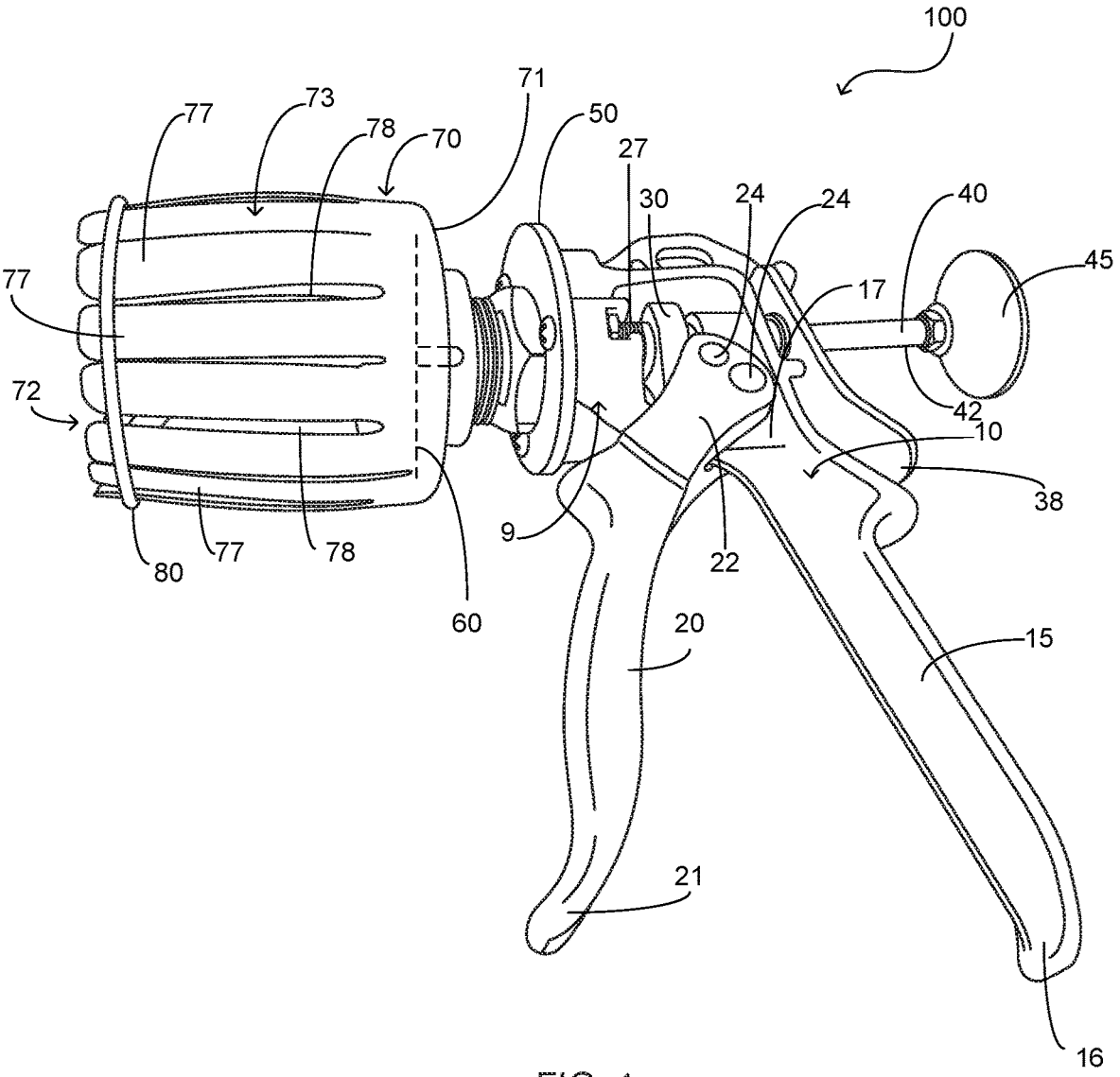
FIG. 1 is a side view of the present invention.

Referring now to the drawings submitted herewith, wherein various elements depicted therein are not necessarily drawn to scale and wherein through the views and figures like elements are referenced with identical reference numerals, there is illustrated light installation tool 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the drawing submitted herewith, the light installation tool 100 includes a body 10, wherein the body 10 is manufactured from a durable lightweight metal such as but not limited to aluminum. The body 10 includes a handle 15 wherein the handle has a first end 16 and second end 17. The handle 15 is manufactured of a sufficient size and length so as to be operably engaged with a hand of a user. Operably coupled to the handle 15 is lever 20. Lever 20 is elongated in form and includes a first end 21 and second end 22. The lever 20 is biasly mounted to the handle 15 proximate the second end 17 thereof utilizing a suitable element such as but not limited to a spring 27. The lever 20 is pivotally moved with a user's hand so as to advance the plunger rod 40 as is further discussed herein. The lever 20 is operably coupled at second end 22 utilizing fasteners 24. It should be understood within the scope of the present invention that the fasteners 24 could be various conventional mechanical fasteners such as but not limited to rivets. Furthermore, it should be understood within the scope of the present invention that the lever 20 could be formed in various sizes and shapes and still achieved the functionality as described herein.

The lever 20 is operably coupled with the drive mechanism 30. The drive mechanism 30 is surroundably mounted the plunger rod 40 and is configured to provide forward movement thereof with each movement of the lever 20 towards the handle 15. The drive mechanism 30 is configured to engage the plunger rod 40 wherein each movement of the lever 20 results in an incremental discrete forward movement of the plunger rod 40. Operably coupled to the second end 42 of the plunger rod 40 is an engagement knob 45. Engagement knob 45 is secured to the second end 42 utilizing suitable techniques and is operable to provide a means for a user to return the plunger rod 40 to a first position. In the first position of the plunger rod 40 the drive plate 60 is proximate the bottom 71 of the light insertion member 70. During installation of a light 99, the plunger rod 40 is advanced forward wherein the drive plate 60 traverses through the interior volume of the light insertion member 70 towards opening 72. Ensuing installation of a light 99, the user will depress plunger lever 38 so as to disengage the drive mechanism 30 from the plunger rod 40 and use the engagement knob 45 to return the plunger rod 40 to its first position. It should be understood within the scope of the present invention that the engagement knob 45 could be formed in various alternate sizes and shapes.

Figure 2:
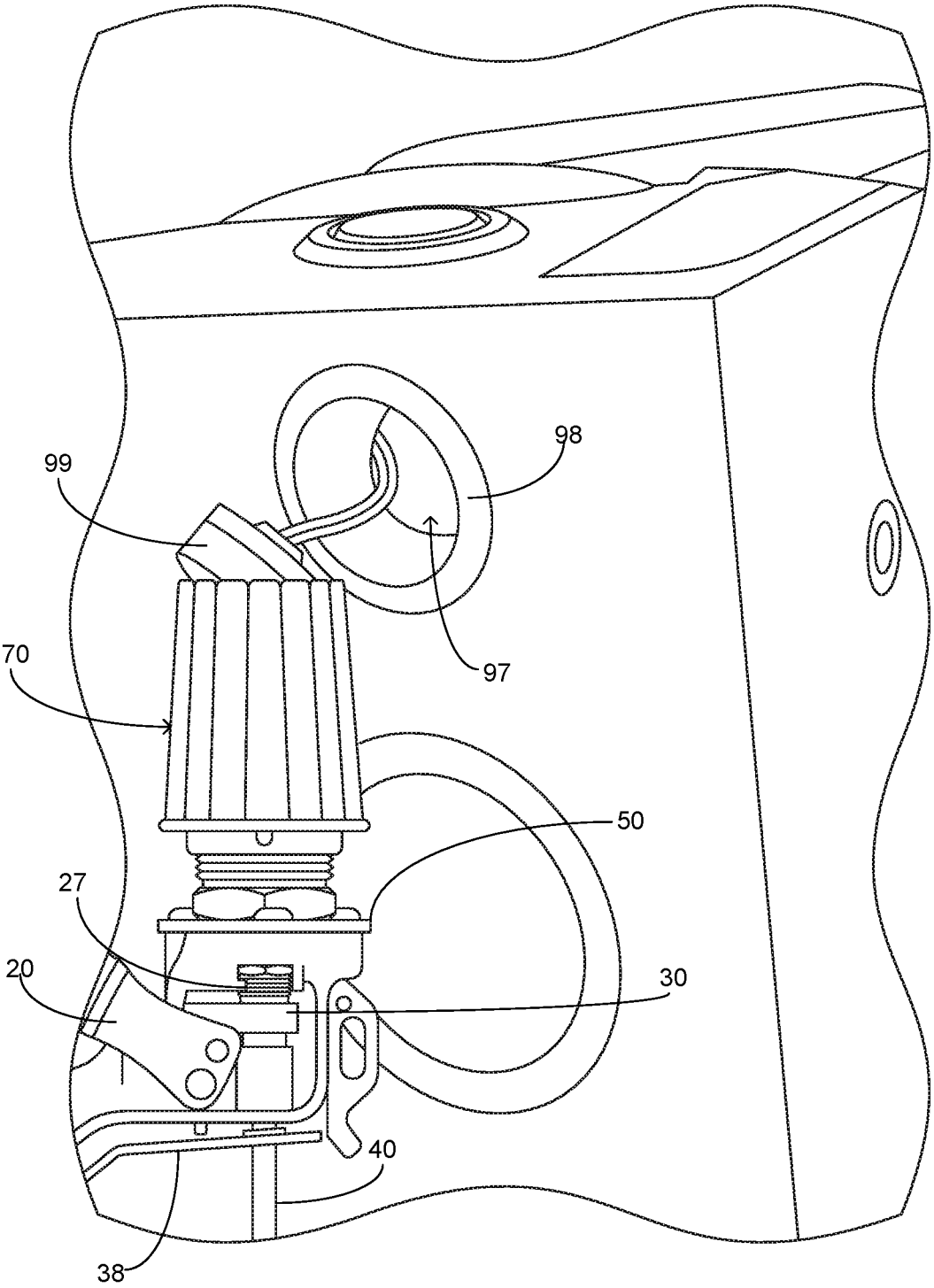
FIG. 2 is a side perspective view of the present invention operably coupled with an exemplary clearance light.
Figure 3:
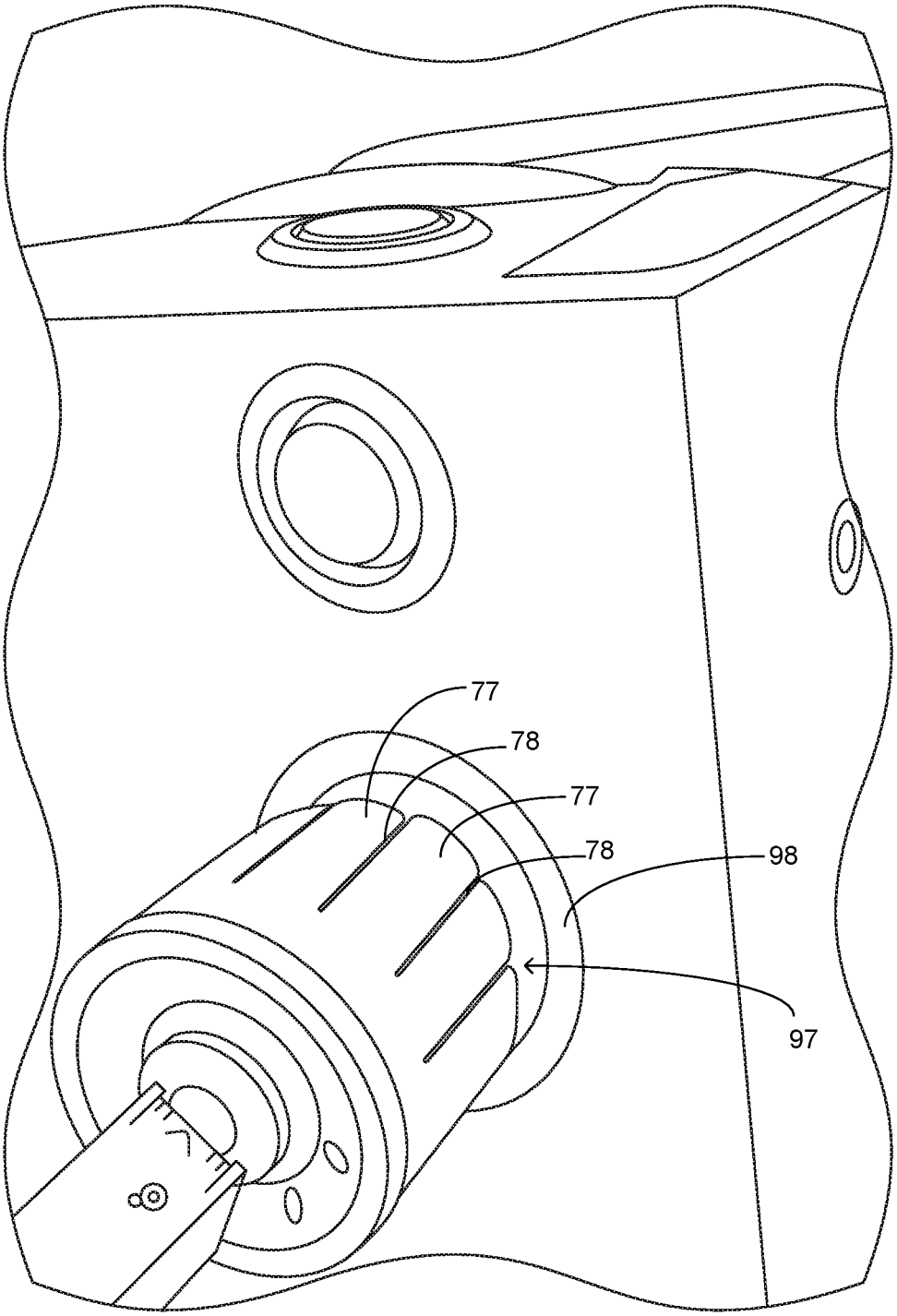
FIG. 3 is a rear perspective view of the present invention during installation of a clearance light.

The body 10 includes base plate 50 wherein the base plate 50 is annular in shape and is manufactured from a rigid material such as but not limited to metal. The base plate 50 is secured to the top end 9 of the body 10 and has an aperture (not particularly illustrated herein) that allows the plunger rod 40 to be moveably journaled therethrough. The base plate 50 is configured to have a light insertion member 70 operably coupled thereto. As illustrated herein in FIGS. 2 and 3, the light insertion member 70 is operable to have a light 99 placed into the interior volume thereof and subsequently be inserted into the light receptacle 98 interior volume 97. The light insertion member 70 is provided in a plurality of diameters so as to accommodate lights 99 of alternate sizes. The light insertion member 70 is cylindrical in shape having a wall 73. The wall 73 is divided into a plurality of elongated segments 77 wherein the segments 77 extend from the perimeter edge 74 to terminate proximate the bottom 71. The segments 77 are independently movable with respect to each other which is facilitated by gaps 78 that are present intermediate each adjacent segment 77. The plurality of segments 77 allow for both a slight expansion and compression movement of the wall 73. The aforementioned movement provides the ability for the light insertion member 70 to accommodate a light 99 into the interior volume thereof and additionally provides an improved insertion into the interior volume 97 of the light receptacle 98. It should be understood within the scope of the present invention that the wall 73 could be comprised of various quantities of segments 77. Ensuing placement of the light 99 into the interior volume of the light insertion member 70, the drive plate 60 will operably engage the light 99 and traverse the light 99 outwards from the light insertion member 70 via the opening 72 during the installation process of the light 99 into the light receptacle 98. While the wall 73 is illustrated herein as including a plurality of segments 77, it is contemplated within the scope of the present invention that the wall 73 could be formed from a solid material wherein the material possesses a slight pliable and/or flexible characteristic so as to achieve the compression and/or expansion previously discussed herein.

An o-ring 80 can be mounted to the exterior surface of the wall 73 as illustrated herein in FIG. 1. The o-ring 80 is a conventional o-ring and is operable to maintain a slight inward bias on the plurality of segments 77 of the wall 73. The presence of the o-ring 80 can provide a slight inward bias to assist in the initial placement of the light insertion member 70 into the light receptacle 98. It should be understood within the scope of the present invention that the light insertion member 70 can be utilized either with or without the o-ring 80.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A light installation tool configured to provide installation of a light wherein the light insertion tool comprises:

a body, said body having a handle, said body further having a lever, said lever being operably coupled to said handle;

a drive mechanism, said drive mechanism being operably coupled to said lever;

a plunger assembly, said plunger assembly having a plunger rod, said plunger rod having a first end and a second end, said plunger rod being operably engaged with said drive mechanism, said plunger rod configured to be moved linearly in a discrete increment without rotation by said drive mechanism during a corresponding movement of said lever;

a light insertion member, said light insertion member having a bottom and a wall contiguously formed to define an inner cavity, said light insertion member having an interior volume and an opening distal to said bottom; said light insertion member further comprising a plurality of segments extending from said wall defining said inner cavity, and a drive plate secured to the second end of the plunger rod, said drive plate being disposed within the interior volume of said light insertion member;

wherein said light insertion member is configured to have the light placed in the interior volume thereof in contact with the drive plate and subsequently be at least partially inserted into a light receptacle so as to facilitate installation of the light therein, and wherein the linear movement of the plunger rod drives the drive plate through the light insertion member, thereby fully inserting the light into the light receptacle and fully removing the light from the light insertion member.

2. The light installation tool as recited in claim 1, and further including a base plate, said base plate being secured to said body, said base plate providing a mounting surface for said light insertion member.

3. The light installation tool as recited in claim 2, and further including a plunger lever, said plunger lever being operably coupled to said plunger rod, said plunger lever operable to facilitate a rearward movement of the plunger rod so as to place the drive plate proximate said bottom of said light insertion member.

4. The light installation tool as recited in claim 3, and further including an engagement knob, said engagement knob being secured to said first end of said plunger rod.

5. The light installation tool as recited in claim 4, and further including an o-ring, said o-ring being circumferentially disposed on an exterior surface of the wall of said light insertion member.

6. A light installation tool configured to facilitate installation of a clearance light wherein the light installation tool comprises:

a body, said body having a handle, said handle having a first end and a second end, said body further having a lever, said lever having a first end and a second end, said lever being pivotally coupled at said second end thereof proximate said second end of said handle;

a plunger assembly, said plunger assembly having a plunger rod, said plunger rod having a first end and a second end, said plunger rod configured to be moved linearly in a discrete increments without rotation during a corresponding movement of said lever;

a drive mechanism, said drive mechanism being operably coupled to said lever, said drive mechanism being surroundably mounted to a portion of said plunger rod, said drive mechanism providing the discrete linear movements of said plunger rod upon movement of said lever;

a light insertion member, said light insertion member having a bottom and a wall contiguously formed to define an inner cavity, said light insertion member having an interior volume and an opening distal to said bottom, said light insertion member further comprising a plurality of longitudinal segments extending from said wall defining said inner cavity; and a drive plate secured to the second end of the plunger rod, said drive plate being disposed within the interior volume of said light insertion member, said drive plate configured to egress a the light disposed in the interior volume of said light insertion member wherein said light insertion member is configured to have a light placed in the interior volume thereof and subsequently be at least partially inserted into a light receptacle so as to facilitate installation of the light therein, and wherein the linear movement of the plunger rod drives the drive plate through the light insertion member, thereby fully inserting the light into the light receptacle and fully removing the light from the light insertion member.

7. The light installation tool as recited in claim 6, wherein the plurality of longitudinal segments of said wall of said light insertion member include a gap intermediate each adjacent segment.

8. The light installation tool as recited in claim 7, and further including a base plate, said base plate being secured to said body proximate said second end of said lever, said base plate providing a mounting surface for said light insertion member.

9. The light installation tool as recited in claim 8, and further including an engagement knob, said engagement knob being secured to said first end of said plunger rod.

10. The light installation tool as recited in claim 9, and further including a plunger lever, said plunger lever being operably coupled to said plunger rod, said plunger lever operable to facilitate a rearward movement of the plunger rod so as to place the drive plate proximate said bottom of said light insertion member.

11. The light installation tool as recited in claim 10, and further including an o-ring, said o-ring being circumferentially disposed on an exterior surface of the wall of said light insertion member, said o-ring providing an inward bias of said plurality of segments of said wall.

* * * * *